United States Patent [19]

Gardner

[11] 4,176,983

[45] Dec. 4, 1979

[54] VARIABLE ECCENTRIC DEVICE

[75] Inventor: James F. Gardner, Cranbury, N.J.

[73] Assignee: Ingersoll-Rand Company, Woodcliff Lake, N.J.

[21] Appl. No.: 924,921

[22] Filed: Jul. 17, 1978

[51] Int. Cl.[2] ..... E01L 19/38

[52] U.S. Cl. ..... 404/117; 74/87; 198/752; 404/113

[58] Field of Search ..... 404/117, 113, 114, 133; 74/87, 61; 198/220 D

[56] References Cited

U.S. PATENT DOCUMENTS

| | | | |
|---|---|---|---|
| 3,011,355 | 12/1961 | Carrier | 74/87 |
| 3,192,839 | 7/1968 | Vivier | 404/117 |
| 3,358,815 | 12/1967 | Musschoot | 74/61 X |
| 3,376,021 | 4/1968 | Fontaine | 74/87 X |
| 3,656,419 | 4/1972 | Boone | 74/87 X |
| 3,772,923 | 11/1973 | Burt | 74/61 |
| 3,783,701 | 1/1974 | Steprath | 74/87 |

*Primary Examiner*—Nile C. Byers, Jr.
*Attorney, Agent, or Firm*—Bernard J. Murphy

[57] ABSTRACT

The device comprises a motor-rotatable unit which includes a rotary shaft having an eccentric mass and a shaft-enveloping sleeve—which sleeve also has an eccentric mass or eccentric weighted portion. The sleeve, which envelops the shaft, is movable in order to effect juxtaposed, radial alignment of the sleeve mass or weighted portion with the shaft eccentric mass, or a diametrically opposite disposition of the sleeve mass or weighted portion (relative to the shaft eccentric mass), so that the two masses effect an additive unbalance, or, eccentricity, cancel out eccentricity, or produce any in between value of eccentricity. Conduits formed in the shaft admit and discharge pressured fluid to and from the shaft and sleeve interface, to cause selective, rotary movement of the sleeve.

14 Claims, 2 Drawing Figures

VARIABLE ECCENTRIC DEVICE

Figure 1:
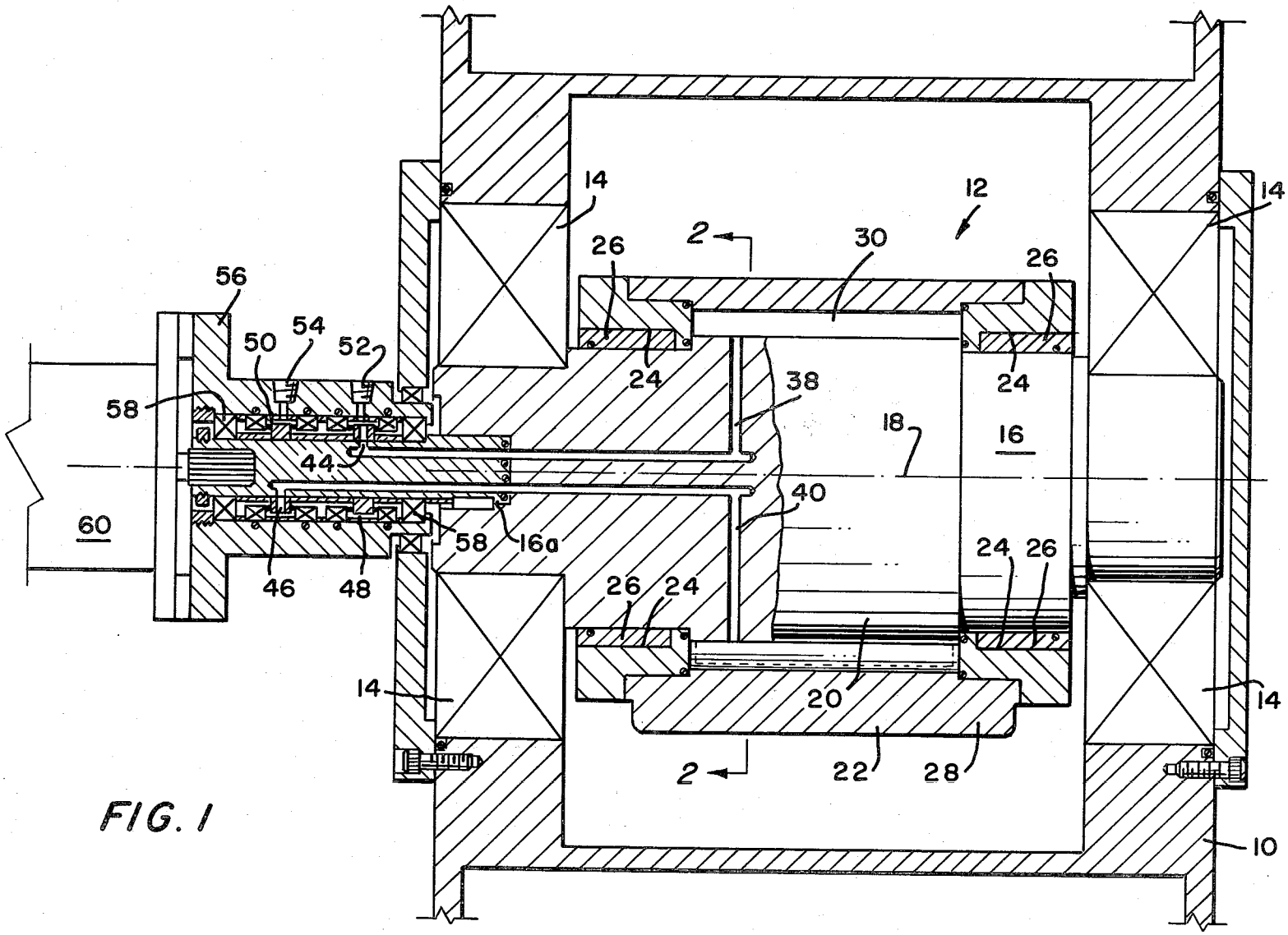

This invention pertains to eccentric-motion devices, and in particular to variable eccentric devices especially adapted for vibratory mechanisms for use in earth compactors, or the like.

Devices of the aforesaid type are well known in the prior art and, among other arrangements, comprises a pair of mutually-engaged and relatively rotatable elements, viz., a shaft and a sleeve, for instance, which elements have eccentric masses. Typical of such is the "Adjustable Vibration Cylinder, Notably for Road Roller," disclosed in U.S. Pat. No. 3,192,839, issued July 6, 1965 to Claude Vivier. The patentee's Adjustable Cylinder comprises a shaft with an eccentric mass and a sleeve rotatably enveloping the shaft—the sleeve too having an eccentric mass. Means wholly external to the sleeve and shaft are provided for rotating the assembly, and for selectively disposing the sleeve in any chosen rotary disposition—relative to the shaft—to effect maximum or minimum eccentric-vibration. The patentee set forth an adjustment control comprising a line supplying hydraulic fluid to a cylinder with means for angularly adjusting a pinion shaft to effect angular reorientation of the sleeve (relative to the shaft).

It is an object of this invention to disclose a much simplified Device, which is capable of low cost manufacture and offers durability and minimal maintenance.

It is an object of this invention, particularly, to set forth a variable eccentric device, for a vibratory mechanism of an earth compactor, comprising a shaft having a rotary axis; said shaft having a mass which is eccentric to said axis; an annular sleeve in envelopment of said mass and an axial portion of said shaft; said sleeve having a weighted portion which is eccentric to said axis; said shaft and said sleeve being coupled together for relative rotary motion thereof between a first relative positioning, in which said mass and said weighted portion are juxtaposed in radial alignment, and a second relative positioning, in which said mass and said weighted portion are diametrically opposed; and means for effecting said relative rotary motion of said shaft and said sleeve; wherein said motion-effecting means comprises means for addressing motive, pressured fluid to a sleeve-enveloped surface of said shaft and to a shaft-enveloping surface of said sleeve.

Equally, it is an object of this invention to disclose a simplified variable eccentric device, for a vibratory mechanism of an earth compactor, comprising first means defining a cylinder; second means defining a rotary piston; said first and second means being mutually engaged for relative rotation, therebetween, about a given axis; wherein said first and second means each have a portion which is eccentric to said axis; and means for addressing motive, pressured fluid between said cylinder and piston to effect a relative rotation thereof, to dispose said eccentric portions in radial, juxtaposed alignment, and in diametrical opposition, selectively.

Figure 2:
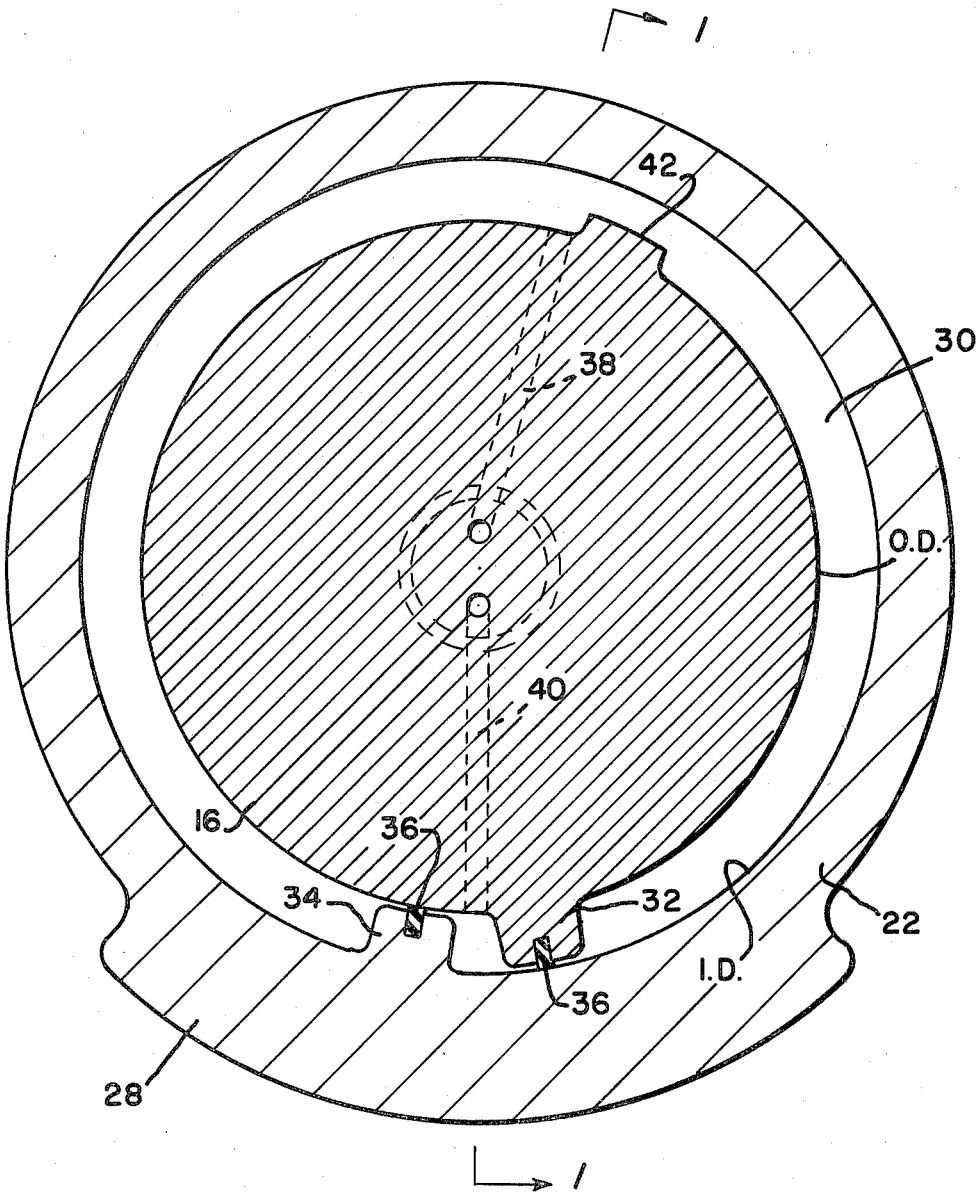

Further objects of this invention, as well as the novel features thereof, will become more apparent by reference to the following description, taken in conjunction with the accompanying Figures, in which:

FIG. 1 is an axial, cross-sectional view of an embodiment of the invention, incorporated in a vibratory mechanism of an earth compactor drum, taken along section 1—1 of FIG. 2; and FIG. 2 is a cross-sectional view taken along section 2—2 of FIG. 1.

As shown in the Figures, an earth compactor drum 10 (only a portion thereof being shown) rotatively and therewithin supports the novel Device 12 on bearings 14, in a given embodiment of the invention. Device 12 comprises a shaft 16 having a rotary axis 18 and an eccentric mass 20. A sleeve 22 envelops an intermediate portion of the shaft, i.e., a portion of the shaft 16 whereat the mass 20 is carried. Each end of the sleeve 22 has an inner hub or circular land 24 which receives an annular, shell-type bearing 26 within which rotatively to receive mass-adjacent portions of the shaft. Sleeve 22 also has an eccentric portion 28 which, as will be explained, is rotatively or angularly displaceable relative to shaft 16.

Shaft 16 has a given outside diameter "O.D.," and sleeve 22 has an inside diameter "i.d.," which is concentric with said shaft outside diameter "O.D.," and cooperates therewith to define an annular space 30 between the shaft 16 and sleeve 22. Shaft 16 has an outwardly extending, and axially disposed, rib 32 which slidably engages the inside diameter surface of the sleeve 22. So also, the sleeve 22 has an inwardly extending, and axially disposed rib 34 which slidably engages the outside diameter surface of the shaft 16. Ribs 32 and 34 carry fluid seals 36 to effect sealing engagements with their complementary (sleeve, shaft) surfaces. These seals also wrap around to effect axial (or side) sealing for fluid containment.

Upon the ribs 32 and 34 moving apart from each other, i.e., with rib 34 becoming angularly/rotatively displaced from rib 32, eccentric portion 28 of the sleeve 22 is moved from its FIG. 2 positioning, wherein its eccentricity is additive to eccentric mass 20, toward an angular positioning wherein it is subtractive or counterbalancing to mass 20. Accordingly, to dispose the portion 28 and mass 20 in radial juxtaposition, to cause them to induce their additive, maximum eccentricity, it is only necessary to move ribs 32 and 34 into closure upon each other. Patently then, to do the opposite will yield the contrary result: minimum eccentricity. Device 12 includes simple conduit means for moving ribs 32 and 34 into and out of proximity with each other.

A first conduit 38 penetrates an axial portion of the shaft 16 and opens onto a surface of the shaft approximately diametrically opposite rib 32. A second conduit 40 also penetrates the same axial portion of the shaft 16, but opens onto a surface of the shaft in immediate adjacency to rib 32. Then, by admitting hydraulic fluid under pressure through conduit 40, between adjacent ribs 32 and 34, and by venting such fluid from annular space 30, via conduit 38 (see FIG. 2), sleeve 22 will rotate, clockwise. Clearly, to return sleeve 22 to its original (FIG. 2) positioning, the conduits 38 and 40 are put to opposite uses: hydraulic fluid under pressure is admitted through conduit 38 into space 30, and such fluid is evacuated from between the shaft 16 and sleeve 22 via conduit 40.

The hydraulic fluid, for being a substantially incompressible medium, presents a substantially solid mass (within space 30) which maintains ribs 32 and 34 in their selectively-disposed relationships. Accordingly, if conduit 38 evacuates a given amount of hydraulic fluid from chamber 30, conduit 40 replaces the same given amount. Chamber 30, then, is always fully charged with hydraulic fluid.

A rib-engaging, limit-stop ridge 42 is formed, axially, on an outer surface of shaft 16. It delimits the angular travel of rib 34; conduit 38 opens onto the o.d. surface of shaft 16 in immediate adjacency to ridge 42.

Conduits 38 and 40 extend axially from shaft 16 into a shaft stub 16*a* which is drivingly engaged with shaft 16 (via a key/keyway and press fit engagement). Conduit 38 opens onto a surface of shaft stub 16*a* through a radial port 44, and conduit 40 also opens onto a surface of shaft stub 16*a* through a radial port 46. Ports 44 and 46 open onto separate annular channels 48 and 50 which, in turn, are axially sealed therebetween and communicate with separate, external fluid ports 52 and 54 formed in a flanged, fixed motor-mounting collar 56. Collar 56 carries a pair of shaft stub bearings 58. The flange-mounted hydraulic motor 60 drives the Device 12 through shaft stub 16*a* and shaft 16.

While I have described my invention in connection with a specific embodiment thereof, it is to be clearly understood that this is done only by way of example, and not as a limitation to the scope of my invention as set forth in the objects thereof and in the appended claims.

I claim:

1. A variable eccentric device, for a vibratory mechanism of an earth compactor, or other device, comprising:

first means defining a shaft having a rotary axis;

said shaft having a mass which is eccentric to said axis;

second means defining an annular sleeve in envelopment of said mass and an axial portion of said shaft;

said shaft and said sleeve having rib means which cooperate to define a variable-volume chamber therebetween;

said sleeve having a weighted portion which is eccentric to said axis;

said shaft and said sleeve being coupled together for relative rotary motion thereof between a first relative positioning, in which said mass and said weighted portion are juxtaposed in radial alignment, and a second relative positioning, in which said mass and said weighted portion are diametrically opposed; and means coupled to one of said first and second means operative for effecting said relative rotary motion of said shaft and said sleeve; wherein said motion-effecting means comprises means for supplying motive, pressured fluid to said variable-volume chamber to effect relative displacement between said rib means, with concomitant variation of the volume of said chamber, and relative rotation between said shaft and said sleeve.

2. A variable eccentric device, according to claim 1, wherein:

surfaces of said shaft, said sleeve, and said rib means cooperatively define said variable-volume chamber; and said fluid-supplying means comprises means for introducing pressured fluid into, and for evacuating fluid from, said variable-volume chamber.

3. A variable eccentric device, for a vibratory mechanism of an earth compactor, or other device, comprising:

first means defining a shaft having a rotary axis;

said shaft having a mass which is eccentric to said axis;

second means defining an annular sleeve in envelopment of said mass and an axial portion of said shaft;

said sleeve having a weighted portion which is eccentric to said axis;

said shaft and said sleeve being coupled together for relative rotary motion thereof between a first relative positioning, in which said mass and said weighted portion are juxtaposed in radial alignment, and a second relative positioning, in which said mass and said weighted portion are diametrically opposed; and means coupled to one of said first and second means operative for effecting said relative rotary motion of said shaft and said sleeve; wherein said motion-effecting means comprises means for addressing motive, pressured fluid to a sleeve-enveloped surface of said shaft and to a shaft-enveloping surface of said sleeve;

said shaft has a rib projecting radially therefrom which rotatably and slidably engages said surface of said sleeve;

said sleeve has a rib projecting radially therefrom which rotatably and slidably engages said surface of said shaft;

said ribs are substantially closed upon each other during said second relative positioning of said shaft and said sleeve, and substantially diametrically opposite each other during said first relative positioning of said shaft and said sleeve; and said fluid-addressing means comprises means for introducing pressured fluid between said ribs to cause said ribs to close upon, and move apart from, each other.

4. A variable eccentric device, for a vibratory mechanism for an earth compactor, or other device, comprising:

first means defining a shaft having a rotary axis;

said shaft having a mass which is eccentric to said axis;

second means defining an annular sleeve in envelopment of said mass and an axial portion of said shaft;

said sleeve having a weighted portion which is eccentric to said axis;

said shaft and said sleeve being coupled together for relative rotary motion thereof between a first relative positioning, in which said mass and said weighted portion are juxtaposed in radial alignment, and a second relative positioning, in which said mass and said weighted portion are diametrically opposed; and means coupled to one of said first and second means operative for effecting said relative rotary motion of said shaft and said sleeve; wherein said motion-effecting means comprises means for addressing motive, pressured fluid to a sleeve-enveloped surface of said shaft and to a shaft-enveloping surface of said sleeve;

said shaft has a rib projecting radially therefrom which rotatably and slidably engages said surface of said sleeve;

said sleeve has a rib projecting radially therefrom which rotatably and slidably engages said surface of said shaft;

said ribs are substantially closed upon each other during said second relative positioning of said shaft and said sleeve, and substantially diametrically opposite each other during said first relative positioning of said shaft and said sleeve;

said fluid-addressing means comprises means for introducing pressured fluid between said ribs to cause said ribs to close upon, and move apart from, each other;

said eccentric mass is defined by a radial sector of said shaft which, relative to said rotary axis, comprises a greatest radius;

said shaft rib projects from the midpoint of said sector; and said fluid-addressing means includes a first fluid conduit formed in said shaft and opening, at one end thereof, through a first port formed in a surface of said shaft in immediate adjacency to said shaft rib.

5. A variable eccentric device, according to claim 4, wherein:

said fluid-addressing means further includes a second fluid conduit formed in said shaft and opening, at one end thereof, through a second port formed in a surface of said shaft substantially diametrically opposite to said first port.

6. A variable eccentric device, for a vibratory mechanism of an earth compctor, or other device, comprising:

first means defining a cylinder;

second means defining a rotary piston;

said first and second means being coaxially engaged for relative rotation, therebetween, about a given axis;

said cylinder and said piston having rib means which define relatively movable fluid impingement surfaces; wherein said first and second means each have a portion which is eccentric to said axis; and means for supplying motive, pressured fluid between said rib means for impingement upon said surfaces thereof to effect relative displacements between said rib means and concomitant relative rotations between said cylinder and piston, to dispose said eccentric portions in radial, juxtaposed alignment, and in diametrical opposition, selectively.

7. A variable eccentric device, according to claim 6, wherein:

said first means comprises a sleeve;

said sleeve is in envelopment of said piston;

said rib means of said sleeve and said piston cooperate to define at least one, variable-volume chamber therebetween; and said fluid-supplying means comprises means for conducting pressured fluid into, and for evacuating fluid from, said variable-volume chamber.

8. A variable eccentric device, according to claim 7, wherein:

said sleeve has an annular wall;

said wall has a first, uniform thickness throughout a substantial and first, circumferential portion thereof, and a second thickness throughout a lesser and second, circumferential portion thereof.

9. A variable eccentric device, according to claim 8, wherein:

said first circumferential portion of said wall is eccentric to said axis.

10. A variable eccentric device, according to claim 8, wherein:

said second circumferential portion of said wall is substantially concentric with said axis.

11. A variable eccentric device, according to claim 8, wherein:

said second circumferential portion comprises approximately one-fourth or ninety degrees of arc of said wall; and said second thickness is not less than fifty percent greater than said first thickness.

12. A variable eccentric device, according to claim 7, wherein:

an outer surface of said piston is enveloped by an inner surface of said sleeve;

said outer and inner surfaces are uniformly spaced apart to define said chamber therebetween; and said rib means comprises a radially directed land projecting from each one of said inner and outer surfaces which sealingly engages the other of said inner and outer surfaces.

13. A variable eccentric device, according to claim 12, wherein:

said fluid conducting means comprises conduit means opening onto at least one of said inner and outer surfaces.

14. A variable eccentric device, according to claim 13, wherein:

said conduit means is formed in said piston, and includes a pair of conduits, one conduit of said pair opening onto said outer surface of said piston in immediate adjacency to said land thereof, and the other conduit of said pair opening onto said outer surface substantially opposite said land of said piston.

* * * * *